US005408974A

United States Patent [19]

Lipinski et al.

[11] Patent Number: 5,408,974

[45] Date of Patent: Apr. 25, 1995

[54] CYLINDER MODE SELECTION SYSTEM FOR VARIABLE DISPLACEMENT INTERNAL COMBUSTION ENGINE

[75] Inventors: Daniel J. Lipinski, Livonia; Julian A. LoRusso, Grosse Ile; Donald R. Nowland, Taylor; Jerry D. Robichaux, Southgate; Gregory B. Schymik, Ypsilanti; Teik-Khoon Tan, Ann Arbor, all of Mich.

[73] Assignee: Ford Motor Company, Dearborn, Mich.

[21] Appl. No.: 172,359

[22] Filed: Dec. 23, 1993

[51] Int. Cl.[6] ..... F02D 17/02

[52] U.S. Cl. ..... 123/481; 123/198 F

[58] Field of Search ..... 123/198 F, 481

[56] References Cited

U.S. PATENT DOCUMENTS

| | | | |
|---|---|---|---|
| 4,040,395 | 8/1977 | Demetrescu | 123/481 |
| 4,144,864 | 3/1979 | Kato et al. | 123/198 F |
| 4,188,933 | 2/1980 | Iizuka | 123/198 F |
| 4,224,920 | 9/1980 | Sugasawa et al. | 123/198 F |
| 4,354,471 | 10/1982 | Sugasawa et al. | 123/481 |
| 4,484,551 | 11/1984 | Choma et al. | 123/336 |
| 4,494,502 | 1/1985 | Endo et al. | 123/198 F |
| 4,509,488 | 4/1985 | Forster et al. | 123/481 |
| 4,541,387 | 9/1985 | Morikawa | 123/481 |
| 4,550,704 | 11/1985 | Barho et al. | 123/481 |
| 4,552,114 | 11/1985 | Sano et al. | 123/481 |
| 4,556,026 | 12/1985 | Masuda et al. | 123/198 F |
| 4,655,187 | 4/1987 | Gravestock | 123/481 |
| 4,708,108 | 11/1987 | Sakamoto et al. | 123/339 |
| 4,722,411 | 2/1988 | Ohashi et al. | 180/197 |
| 4,870,934 | 10/1989 | Vanetta et al. | 123/336 |
| 4,962,740 | 10/1990 | Fujimoto et al. | 123/481 |
| 4,976,228 | 12/1990 | Kawamura | 123/90.11 |
| 5,035,220 | 7/1991 | Uchinami et al. | 123/436 |
| 5,042,444 | 8/1991 | Hayes et al. | 123/339 |
| 5,099,816 | 3/1992 | Ohga et al. | 123/481 |
| 5,113,823 | 5/1992 | Iriyama | 123/399 |
| 5,119,781 | 6/1992 | Trombley et al. | 123/325 |
| 5,124,922 | 6/1992 | Akiyama | 364/426.02 |
| 5,190,013 | 3/1993 | Dozier | 123/481 |
| 5,213,081 | 5/1993 | Fujimoto | 123/419 |

FOREIGN PATENT DOCUMENTS

| | | | |
|---|---|---|---|
| 4-041944 | 2/1992 | Japan . | |
| 2114653 | 8/1983 | United Kingdom | 123/481 |

OTHER PUBLICATIONS

"4, 6, 8 . . . Which Cylinder Shall We Operate?", *Motor*, Jun. 25, 1983, pp. 52–53.

D. Stojek and D. Bottomley, "The Ford 3×6 Engine", Proceedings IMech vol. 198D, No. 15, copyright 1984.

G. Berta, M. Troilo, "Cylinder Shut-off and Pressure Charging for Lower Fuel Consumption", SAE 82072, no date.

K. Schellman and W. Schmid, "Possibilities by Saving Fuel by Switching Off Cylinders", Fuel Economy Research Conference, Unknown date & location.

T. Fukui, T. Nakagami, H. Endo, T. Katsumoto and Y. Danno, "Mitsubishi Orion-MD, A New Variable Displacement Engine," SAE 831007, copyright 1983.

B. Bates, J. Dosdall and D. Smith, "Variable Displacement by Engine Valve Control", SAE Paper 780145, 1978.

"Mitsubishi has variable 2 or 4-cylinder engine", Wards Engine and Vehicle Technology Update, Sep. 1, 1992.

"Mitsubishi unveils new fuel savings engine", recent article in Automotive News, Aug.–Sep. 1992.

*Primary Examiner*—Tony M. Argenbright

*Attorney, Agent, or Firm*—Jerome R. Drouillard; Roger L. May

[57] ABSTRACT

A system for selecting the number of cylinders to be operated in a multi-cylinder variable displacement internal combustion engine installed in a vehicle having a driver operable accelerator control includes an accelerator control position sensor for determining the operating position of the accelerator control and an engine speed sensor for determining the speed of the engine, as well as a processor containing stored values for engine load as functions of engine speed and accelerator position and also engine load at wide open throttle. The processor infers engine load based on the accelerator control position and engine speed then selects the number of cylinders of the engine to be operated based at least in part of a comparison of the inferred engine load and the maximum possible load at the same engine speed.

18 Claims, 4 Drawing Sheets

CYLINDER MODE SELECTION SYSTEM FOR VARIABLE DISPLACEMENT INTERNAL COMBUSTION ENGINE

BACKGROUND OF THE INVENTION

This invention relates to a system for selecting the number of cylinders to be operated in a multi-cylinder variable displacement internal combustion engine installed in a vehicle having a driver operable accelerator control.

DESCRIPTION OF THE PRIOR ART

Automotive vehicle designers and manufacturers have realized for years that it is possible to obtain increased fuel efficiency if an engine can be operated on less than the full complement of cylinders during certain running conditions. Accordingly, at low speed, low load operation, it is possible to save fuel if the engine can be run on four instead of eight cylinders or three instead of six cylinders. In fact, one manufacturer offered a 4-6-8 variable displacement engine several years ago, and Ford Motor Company designed a 6-cylinder engine capable of operation on only three cylinders which, although never released for production, was developed to a highly refined state. Unfortunately, both of the aforementioned engines suffered from deficiencies associated with their control systems. Specifically, customer acceptance of the engine system actually in production was unsatisfactory, because the powertrain tended to "hunt" or shift frequently between the various cylinder operating modes. In other words, the engine would shift from 4 to 8 cylinder operation frequently, while producing noticeable torque excursions. This had the undesirable effect of causing the driver to perceive excessive changes in transmission gear in the nature of downshifting or upshifting. Another drawback to prior art systems resided in the fact that the engine's torque response corresponding to a given change in the accelerator control position varied quite widely with the number of cylinders actually in operation. For example, when the engine was in 8-cylinder operation, a given change in the accelerator control position would produce a certain change in engine torque output at any particular engine speed. However, when the engine was operated at less than the total number of cylinders, e.g., 4 or 6 cylinders, for the same change in accelerator control position a much reduced torque response was available. As a result, the vehicles felt sluggish and non-responsive to driver input.

It is an object of the present invention to provide a cylinder mode selection system which provides smoother operation than other known variable displacement engine systems, with less perceivable shifting of the number of cylinders being operated.

It is an advantage of the present invention that the throttle operation produced by the present system will cause changes in the number of cylinders being operated to be transparent with respect to the driver's perception of the engine's throttle response.

It is another advantage of the present invention that mode changes between one number of cylinders to another will be minimized; the present system will provide stable operation and minimize mode "hunting".

SUMMARY OF THE INVENTION

A system for selecting the number of cylinders to be operated in a multi-cylinder variable displacement internal combustion engine installed in a vehicle having a driver-operable accelerator control includes an accelerator control position sensor for determining the operating position of the accelerator control and for generating an accelerator control position signal indicating such position, and an engine speed sensor for determining the speed of the engine and for generating an engine speed signal indicating such speed. A processor containing stored values for engine load as functions of engine speed and accelerator control position, as well as engine load as a function of engine speed at wide open throttle, includes means for receiving the accelerator control position and engine speed and engine load signals and for inferring engine load based on accelerator position and engine speed. The processor further includes means for comparing inferred engine load with the stored value for engine load at wide open throttle at the same engine speed, as well as means for selecting the number of cylinders to be operated based, at least in part, on the results of such comparison. The processor preferably compares a value for the instantaneous load at which the engine is being operated with the stored value of engine load at wide open throttle and at the same engine speed. The processor may select the number of cylinders to be operated based upon the speed of the engine as well as upon engine load. In the event that the engine is operating between high and low limit speeds and at less than a predetermined load value, the processor will select less than the total number of cylinders for operation. Having placed the engine in operation with less than the total number of cylinders, the processor will maintain the engine in such fractional operating condition even if the engine is operated at a speed in excess of the high limit speed, or at a speed which is less than the low limit speed, provided the engine speed lies within a speed/load hysteresis band.

As an alternative to the calculation of engine load based on accelerator control position, a transfer function of accelerator position may be used directly, with the processor calculating the value of an accelerator control position function. This function may include not only the instantaneous position of the accelerator, but also a function of the time rate of change of the accelerator control position. In any event, the processor will select less than the total number of cylinders for operation in the event that the engine is operating between high and low limit speeds and at less than a predetermined accelerator control position function. In effect, operation at a fractional number of cylinders will comprise one island on a map of operation, with a hysteresis band surrounding the map of fractional operation; the portion of the map outlying the hysteresis band comprises the area of maximum cylinder operation.

DETAILED DESCRIPTION OF THE PREFERRED EMBODIMENTS

Figure 1:
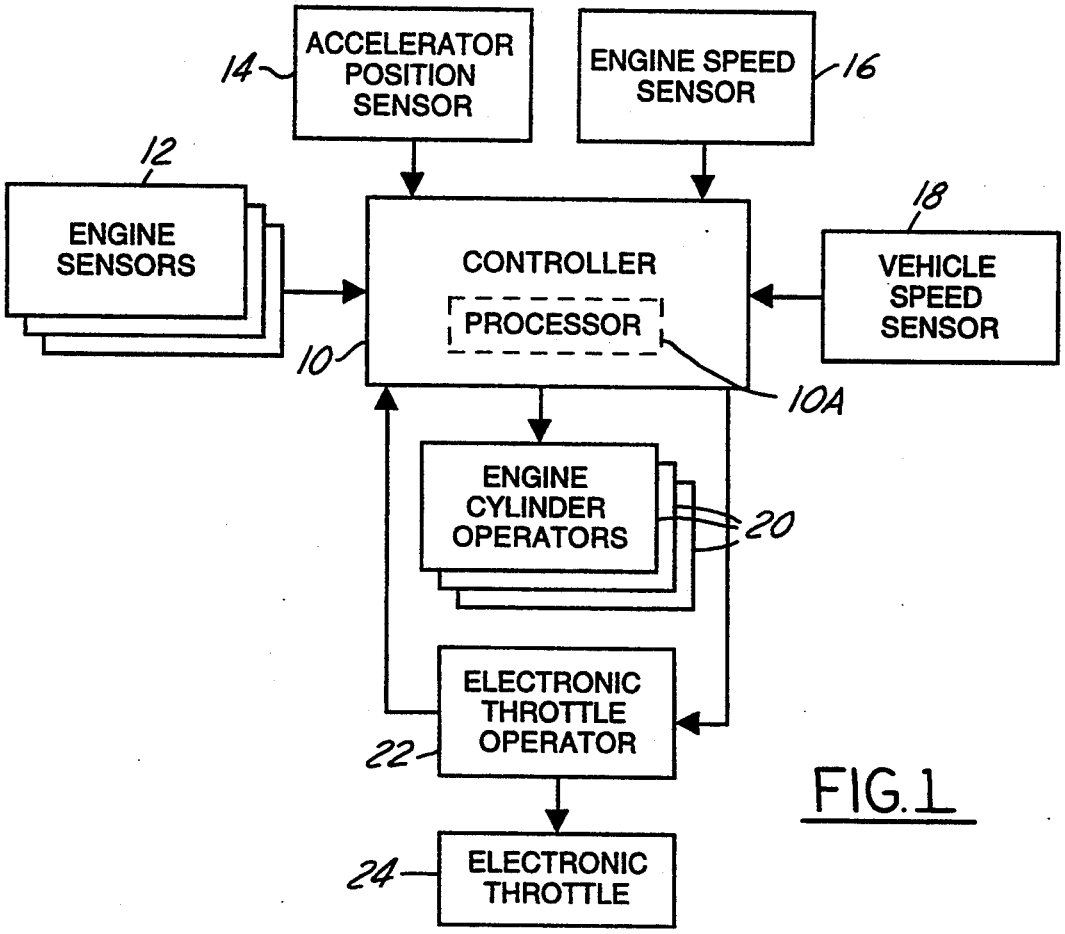
FIG. 1 is a block diagram of a cylinder mode selection system according to the present invention.

As shown in FIG. 1, an automotive engine having a cylinder mode selection system for variable displacement according to the present invention includes microprocessor controller 10 of the type commonly used for providing engine control. Controller 10 contains microprocessor 10A, which uses a variety of inputs from various sensors, such as sensors 12, which may include engine coolant temperature, air charge temperature, engine mass air flow, intake manifold pressure, and other sensors known to those skilled in the art and suggested by this disclosure. Controller 10 also receives information from accelerator control position sensor 14, engine speed sensor 16, and vehicle speed sensor 18. Controller 10 may operate spark timing control, air/fuel ratio control, exhaust gas recirculation (EGR), and other engine and power transmission functions. In addition, through a plurality of engine cylinder operators 20, controller 10 has the capability of disabling the selected cylinders in the engine so as to cause the engine have a decreased effective displacement. For example, with an 8-cylinder engine, the engine may be operated on 4, 5, 6 or 7 cylinders, or even 3 cylinders, as required. Those skilled in the art will appreciate in view of this disclosure that a number of different disabling devices are available for selectively rendering the cylinders of the engine inoperative. Such devices include mechanisms for preventing any of the cylinder valves from opening in the disabled cylinders, such that gas remains trapped within the cylinder.

Controller 10 operates electronic throttle operator 22, which may comprise a torque motor, stepper motor or other type of device used for the purpose of positioning an electronic throttle 24. An electronic throttle is, as its name implies, wholly apart from a mechanically operated throttle which may be employed in connection with the manually operatable accelerator control having position sensor 14 attached thereto. Electronic throttle operator 22 provides feedback to controller 10 of the position of electronic throttle 24.

Figure 2:
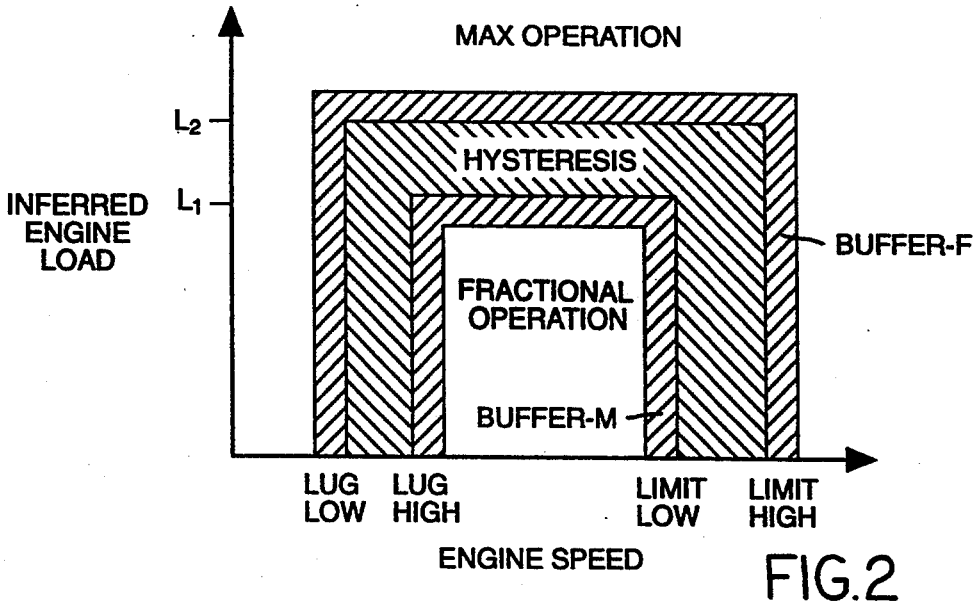
FIG. 2 is an engine operation map showing fractional and maximum cylinder operation based on engine load and engine speed.

As shown in the engine operating map of FIG. 2, fractional operation, which is herein defined as operation with less than the total number of engine cylinders, occurs in an island defined by engine speed and engine load parameters. At any particular operating point, accelerator control position sensor 14 transmits to controller 10 information which is transformed into an accelerator control position signal indicating the position of the accelerator control. The position of the accelerator control is used in the system of the present invention as a reliable indicator of the driver's demand with respect to engine torque or power output. Those skilled in the art will appreciate in view of this disclosure that accelerator control position may be measured at an accelerator pedal, or at a manually controlled throttle valve, or at some intermediate position in a linkage extending between the two. As used herein, the term "acclerator control" means a conventional automotive foot pedal accelerator, or any other type of manually operated accelerator, such as a throttle lever.

As noted above, controller 10 also receives information from engine speed sensor 16, which allows controller 10 to operate the engine according to the operation map illustrated in FIG. 2, which will be explained in conjunction with the flow diagram shown in FIG. 4.

Figure 4:
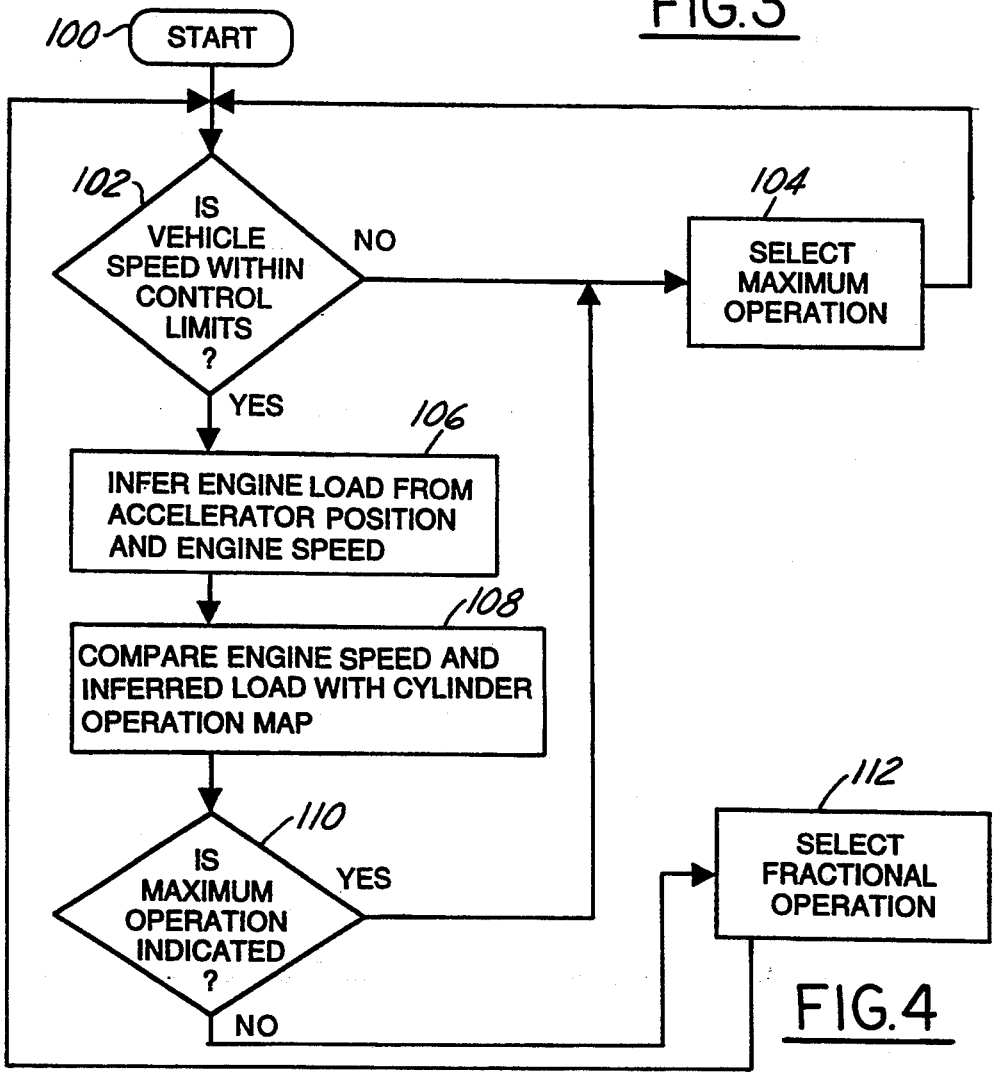
FIG. 4 is a flow chart illustrating the operation of a variable displacement engine according to the present invention using inferred engine load as a control variable.

Turning now to FIG. 4, the cylinder mode selection program begins at block 100 with the initiation of the program. At block 102, the controller inquires as to whether the vehicle speed, as determined by vehicle speed sensor 18 is within control limits.

Operation at less than the total number of cylinders at idle may be undesirable because of noise, vibration and harshness considerations. At high speeds, operation with fewer than the total number of cylinders may simply not produce enough power to drive the vehicle in a noise and vibration-free mode. Accordingly, the vehicle speed is not within the control limits at block 102, the controller selects the maximum operation at block 104 and returns to block 102. As described above, maximum operation simply means that the engine is operated with the greatest number of cylinders so that with an 8-cylinder engine, 8 cylinders are operated; a 6-cylinder engine would correspondingly be operated with 6 cylinders.

If vehicle speed is within the control limits of block 102, the routine passes to block 106. At block 106, contemporaneous engine load is inferred from the accelerator position and engine speed. As used herein, the term "load" means volumetric efficiency, which can be measured in terms of intake manifold pressure or inlet air charge. Processor 10A within controller 10 contains stored values for engine load as functions of engine speed and accelerator control position. It has been determined that a system according to the present invention may be operated with stored load values for either fractional or maximum operation. Processor 10A also contains stored values for engine load as a function of engine speed at wide open throttle. Processor 10A infers engine load by determining the percentage of wide open throttle engine load corresponding with the engine load demanded by the driver, as indicated by the sensed accelerator control position. The wide open throttle load and the loading governed by the accelerator control are compared at the same engine speed. In effect, processor 10A determines the extent to which the engine is being loaded, up to and including the wide open throttle load. The result of this comparison, which is a fraction having a value less than or equal to one, is entered into one of two look-up tables, with each having two dimensions shown in FIG. 2. The look-up tables have inferred engine load and engine speed as independent variables. The lookup tables correspond to fractional and maximum operation. In block 110, processor 10A compares the values for inferred engine load and engine speed with the table values to determine whether maximum operation or fractional operation is indicated. As shown in FIG. 2, an island of fractional operation is at the center of the operation map, surrounded by a hysteresis band, which is itself surrounded by an area of maximum operation. The island of fractional operation is defined by engine speeds shown as "LUG HIGH" and "LIMIT LOW." Thus, when engine speed is higher than the LUG HIGH value but lower than the LIMIT LOW value, fractional operation is indicated. If, however, the engine is operating with the maximum number of cylinders, fractional operation will not be engaged if the engine speed is less than the LUG HIGH value or greater than the LIMIT LOW value. As is further shown in FIG. 2, fractional operation is used where the inferred engine load is less than the $L_1$ value. Maximum operation is used at any engine load value where the engine speed is less than LUG LOW or greater than LIMIT HI. When engine speed is less than LIMIT LOW or greater than LUG HI, maximum operation will still be used at any engine speed if the inferred load is greater than value $L_2$.

A speed/load hysteresis band is imposed between the islands of maximum operation and fractional operation. Thus, once controller 10 places the engine into operation with less than the total number of cylinders, i.e., fractional operation, controller 10 will maintain the engine at a fractional engine operating condition even if the engine is operated at a speed in excess of LIMIT LOW value and up to the LIMIT HI value. Conversely, fractional operation will be maintained even if the engine speed is less than the LUG HI value, provided the speed does not go lower than the LUG LOW value. Maximum operation also is accomplished with the benefit of the hysteresis band of FIG. 2. Thus, at any engine speed between LUG LOW and LIMIT HI, but at engine loads in excess of $L_1$, the engine will stay in 8-cylinder operation even if the load drops below the $L_2$ limit. Also, 8-cylinder operation which is maximum operation with, for example, an 8-cylinder engine, will be maintained if the engine speed lies between the LUG LO and the LUG HI values or the LIMIT LOW and LIMIT HI values at any engine load value.

In order to provide a means for selecting the appropriate lookup table for operation at either fractional or maximum operation, two buffer zones, labeled Buffer-M and Buffer-F are provided. If the engine is operating in a fractional mode and moves into and through the hysteresis band, maximum operation will be selected once the engine speed and inferred load move into Buffer-F. Conversely, if the engine is operating in the maximum mode and moves through the hysteresis band in the direction of the fractional operation island, fractional operation will be selected once the operating point enters Buffer-M.

Continuing now with FIG. 4, at block 110, if maximum operation is indicated, the program moves to block 104 and selects maximum operation. If, however, the maximum operation is not indicated at 110, fractional operation will be selected at block 112 and the routine will continue with block 102.

Figure 3:
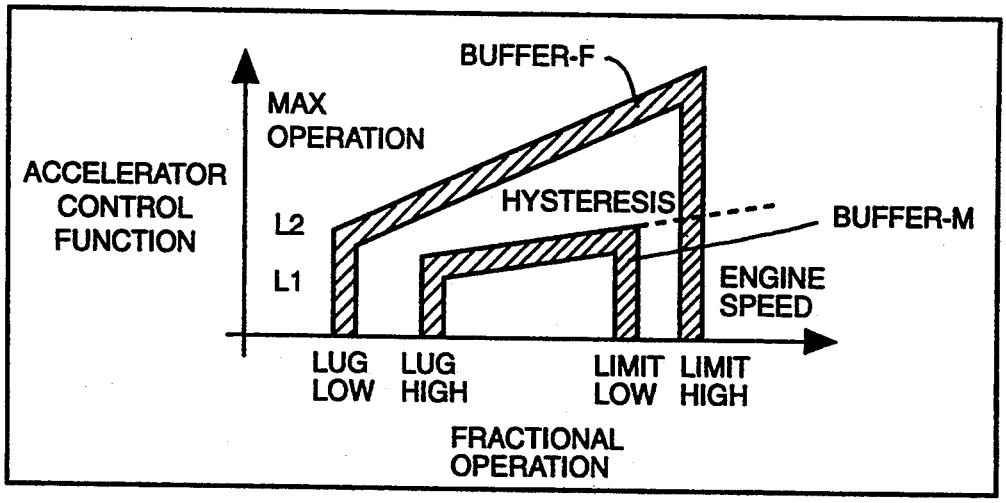
FIG. 3 is an engine operation map based on the value of an accelerator control function as well as engine speed.
Figure 5:
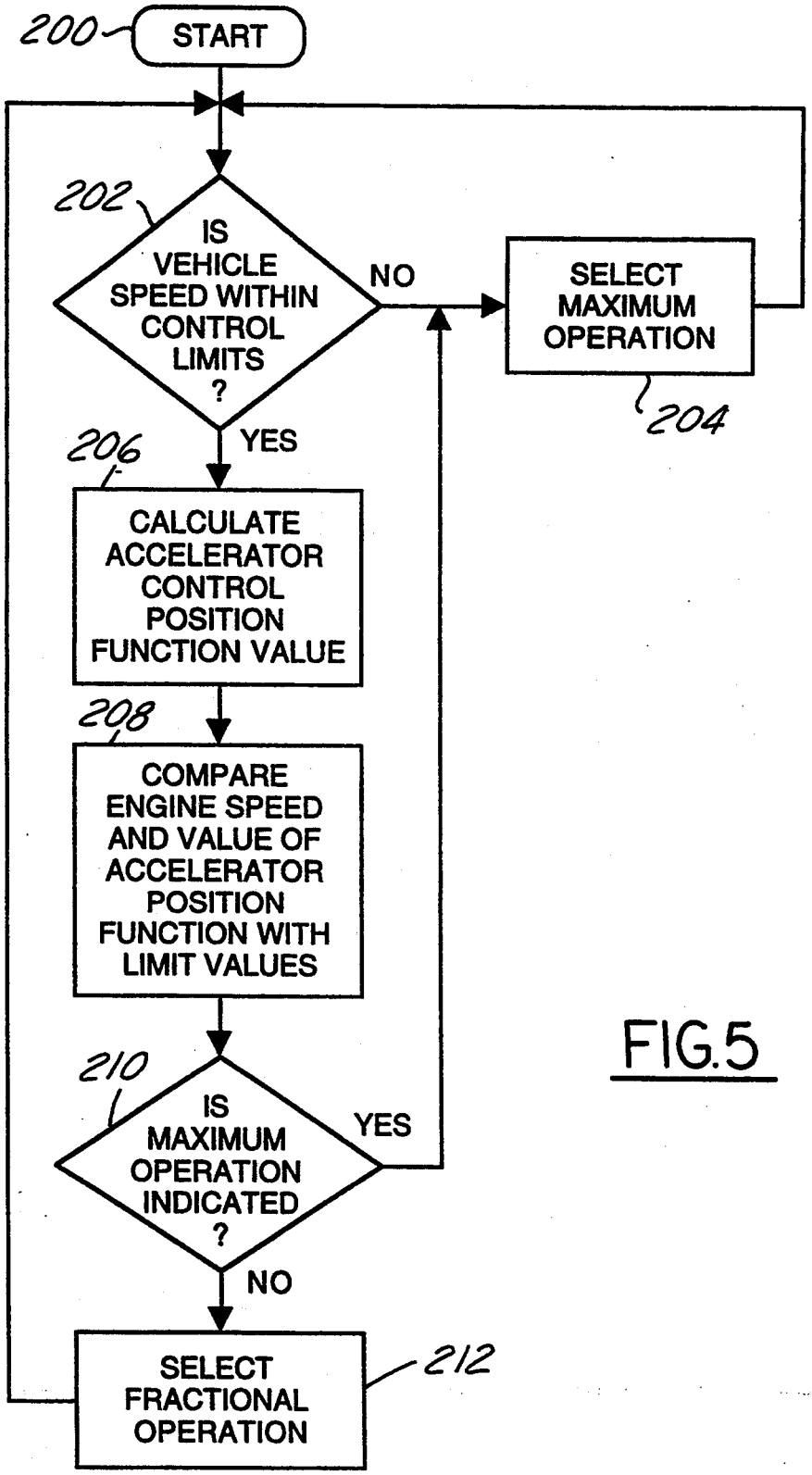
FIG. 5 is a flow chart similar to FIG. 4 but illustrating the use of an accelerator control position function as a control variable.

The engine operation map of FIG. 3 and the flow diagram of FIG. 5 illustrate the use of the present invention with a direct function of accelerator control position. It has been determined that a system according to the present invention will operate in a more responsive fashion if the wishes of the driver are translated via the instantaneous accelerator control position and a function of the time rate of change or, in effect, the velocity of the accelerator control movement. Thus, in FIG. 3, the cylinder operation plot includes in the abscissa engine speed as before, but on the ordinate, includes this accelerator control function.

Beginning now with block 202 in FIG. 5, if the vehicle speed is not within control limits, the maximum operation will be selected as before. If the vehicle speed is within control limits, at block 206 processor 10A will calculate the value of the accelerator control position function. As previously noted, this function will include not only instantaneous position but also the velocity of the accelerator control movement. The value of this function, as well as the instantaneous engine speed, will be compared at block 208 with the mapped values shown in FIG. 3. Notice that the hysteresis band outlining the fractional island of operation has sloped upper and lower limits. These limits are determined by a best fit linear regression analysis of predetermined loads wherein the engine under consideration for application of the present invention produces the best operating characteristics in terms of cylinder selection. Because the system as shown in FIG. 5 utilizes not only accelerator control position but also the rate of change of position, the system will be more responsive and more robust because a more uniform hysteresis band is in effect available for all engine speeds. At block 210, if maximum operation is indicated according to the map of FIG. 3, maximum operation will be selected at block 204. Continuing then, if at block 210 maximum operation is not indicated, fractional operation will be selected at block 212, and the routine continues. The application of the LUG LOW, LIMIT HIGH, LIMIT LOW and LIMIT HIGH and also the $L_1$ and $L_2$ lines and Buffer-M and Buffer-F is the same for this case, as with the previous example. If desired, a system according to the present invention may be implemented such that processor 10A selects predetermined limit values for engine speed and for the transfer function of accelerator control position based upon the amount of time which has elapsed since the prior change in the number of cylinders being operated. This technique may be employed to either narrow or widen the hysteresis band dynamically, so as to maximize the operation in fuel saving modes, but without causing undesirable noise, vibration, and harshness.

Figure 6:
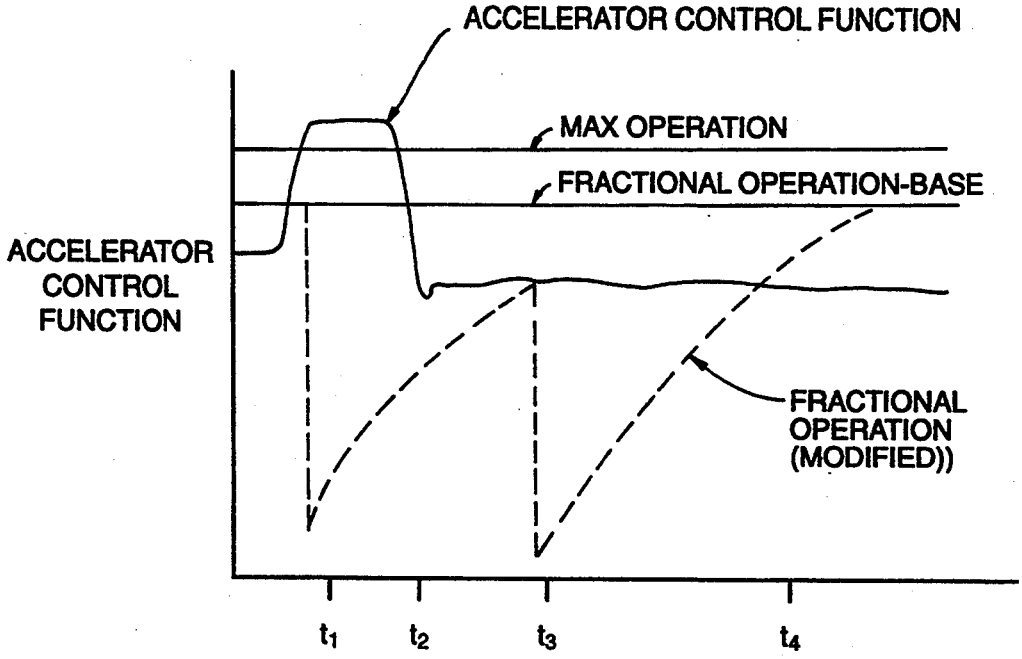
FIGS. 6 and 7 illustrate the use of dynamic hysteresis limits for mode selection according to one aspect of the present invention.
Figure 7:
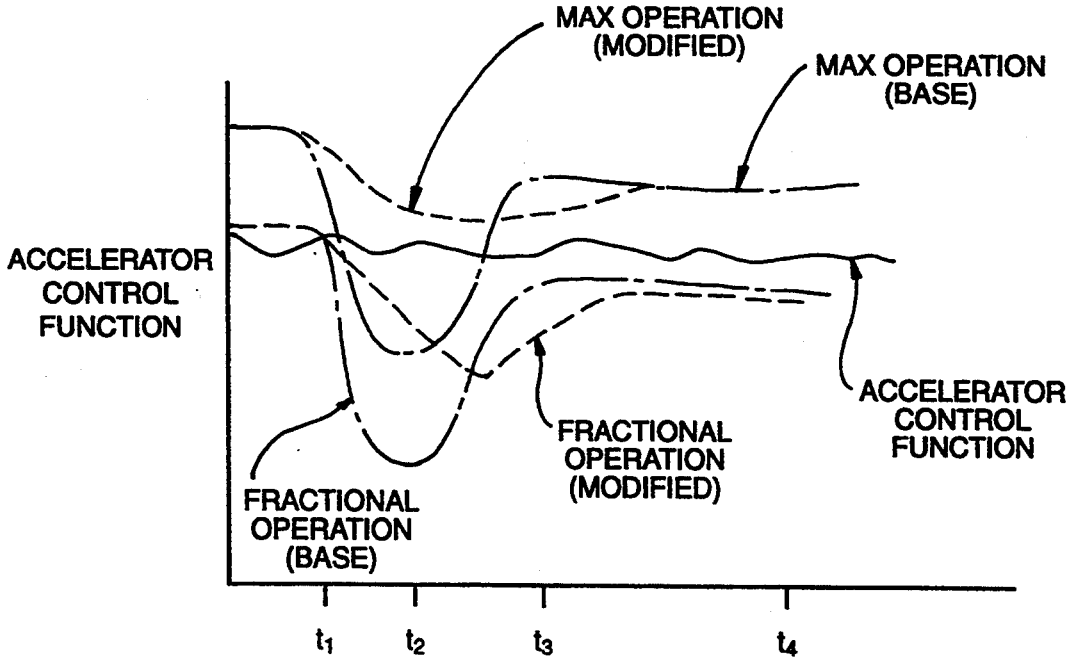

Turning now to FIGS. 6 and 7, it has been determined, as described above, that operation of a system according to the present invention may be enhanced if dynamic hysteresis limits are employed. This will allow the hysteresis band to be as small as possible during steady state operation, so as to maximize the amount of fractional operation, while preventing excessive mode shifting between operation with different numbers of cylinders. The mode selection logic tracks that illustrated in FIGS. 2 and 3. Accordingly, if the value of the accelerator control function exceeds the maximum operation value, maximum operation is selected. If the value of the function is less than the fractional operation line, fractional operation is selected. If the value of the function lies between the maximum and fractional operation lines, the previous operating mode is maintained. Beginning with FIG. 6, the accelerator control function is shown as taking a sharp upswing at time $t_1$. Because the value of the accelerator control function is greater than the max operation line at time $t_1$, processor 10A selects maximum operation. Simultaneously, the fractional operation base line is brought to a lower level, according to the line labeled FRACTIONAL OPERATION (MODIFIED). This line is generated by processor 10A by decrementing the fractional operation base line by a fixed amount, followed by a gradual increase up to the baseline value. In effect, processor 10A generates a value for the modified fractional operation variable as a function of the amount of time between changes in the number of cylinders being operated. Due to this variable hysteresis, when the value of the accelerator control function drops below the line labeled FRACTIONAL OPERATION-BASE, fractional operation will not be selected because the value of the accelerator function lies between the MODIFIED line and the MAX OPERATION line. At time $t_3$, the value of the accelerator position function is approximately equal to the value of FRACTIONAL OPERATION (MODIFIED), which is shown as increasing with time. At time $t_3$, processor 10A will select fractional operation. Simultaneously, the value of the FRACTIONAL OPERATION (MODIFIED) lines is reduced by the same amount as the reduction at time $t_1$. Finally, at time $_4$, the value of the accelerator position function and the FRACTIONAL OPERATION (MODIFIED) line intersect once again. In this case, however, the engine remains in fractional operation, as directed by the mode selection logic.

FIG. 7 shows dynamic alteration of the lines of maximum operation and fractional operation in response to changes in engine speed. If, for example, engine speed decreases sharply, at time $t_1$ as the result of a transmission upshift, the MAX OPERATION (BASE) would also drop significantly, because mode selection is significantly affected by engine speed. If, however, the values generating the MAX OPERATION (BASE) line is filtered, the dotted line labeled MAX OPERATION (MODIFIED) will be generated, with the result that the value of the accelerator control function will remain below the MODIFIED line. Similarly, if the value of the line labeled FRACTIONAL OPERATION (BASE) is filtered, it is seen that the value of the accelerator control function will more likely lie below the resulting line, which is labeled FRACTIONAL OPERATION (MODIFIED). This will cause fractional operation to be selected more often, with resulting savings in fuel consumption.

Those skilled in the art will appreciate in view of this disclosure that logic trees incorporating mathematical calculations could be used for implementing the strategies illustrated by the maps of FIGS. 2 and 3. These and many other modifications and changes may be made to the system described herein without departing from the scope of the invention as set forth in the appended claims.

I claim:

1. A system for selecting the number of cylinders to be operated in a multicylinder variable displacement internal combustion engine installed in a vehicle having a driver operable accelerator control, comprising:

an accelerator control position sensor for determining the operating position of the accelerator control and for generating an acclerator control position signal indicating such position;

an engine speed sensor for determining the speed of the engine and for generating an engine speed signal indicating such speed; and a processor containing stored values for engine load as functions of engine speed and accelerator control position and engine speed at wide open throttle, with said processor further comprising means for receiving said accelerator control position, engine speed, and engine load signals and for inferring engine load based on the accelerator control position and upon engine speed, with said processor further comprising means for comparing the sensed engine load with the stored value for engine load at wide open throttle and the same engine speed and for selecting the number of cylinders to be operated based at least in part upon the results said comparison.

2. A system according to claim 1, wherein said processor compares a value for the instantaneous load at which the engine is being operated with said stored value of engine load at wide open throttle.

3. A system according to claim 1, wherein said processor selects the number of cylinders to be operated based upon the speed of the engine, as well as upon engine load.

4. A system according to claim 3, wherein said processor will select less than the total number of cylinders for operation in the event that the engine is operating between high and low limit speeds, and at less than a predetermined load value.

5. A system according to claim 4, wherein having placed the engine into operation with less than the total number of cylinders, the processor will maintain the engine in such fractional operating condition even if the engine is operated at a speed in excess of the high limit speed, or at a speed which is less than the low limit speed, provided the engine speed lies within a speed/load hysteresis band.

6. A system according to claim 5, wherein the processor will maintain the engine in such fractional operating condition even if the engine is operated at a load which is in excess of the predetermined load value, provided the engine load lies within said band extending about the envelope of fractional operation.

7. A system according to claim 4, wherein said predetermined load value comprises an invariant fraction of the maximum load capability of the engine while operating with the minimum number of cylinders which may be selected by the processor.

8. A system for selecting the number of cylinders to be operated in a multicylinder variable displacement internal combustion engine installed in a vehicle having a driver operable accelerator control, comprising:

an accelerator control position sensor for determining the operating position of the accelerator control and for generating an accelerator control position signal indicating such position as a function of time;

an engine speed sensor for determining the speed of the engine and for generating an engine speed signal indicating such speed; and a processor containing predetermined limit values for engine speed and a transfer function of accelerator control position, with said processor further comprising means for receiving said accelerator control position and engine speed signals, means for calculating the value of said accelerator control position function, and means for selecting fractional operation in the event that sensed engine speed and the value of said accelerator control position function lie between said predetermined limit values.

9. A system according to claim 8, wherein said accelerator control position function includes the instantaneous position of the accelerator and a function of the time rate of change of the accelerator control position.

10. A system according to claim 8, wherein said processor will select less than the total number of cylinders for operation in the event that the engine is operating between high and low limit speeds, and at less than a predetermined accelerator control position function.

11. A system according to claim 8, wherein the processor will maintain the engine in an operating condition of less than the total number of cylinders once such condition is established, even in the event that the engine is operated at a load which is in excess of the predetermined load value, provided the value of the accelerator control position function lies within an engine speed/accelerator control function hysteresis band extending about the envelope of fractional operation.

12. A system according to claim 11, wherein the processor will maintain the engine in a fractional operating condition of less than the total number of cylinders, even if the engine is operated at a speed in excess of the high limit speed, or at a speed which is less than the low limit speed, provided the engine speed lies within said hysteresis band extending about the envelope of fractional operation.

13. A system according to claim 11, wherein the processor will place the engine into operation with the total number of cylinders in the event that the values of both the engine speed and the accelerator position function lie outside of said hysteresis band.

14. A system according to claim 13, wherein the processor, having placed the engine into operation with the total number of cylinders, will maintain such operation in the event that the values of both the engine speed and the accelerator position function move into said hysteresis band.

15. A system according to claim 8, wherein the processor selects predetermined limit values for engine speed and for the transfer function of accelerator control position based upon the amount of time which has elapsed since the prior change in the number of cylinders being operated.

16. A system according to claim 8, wherein the processor will select an operating condition with less than the maximum number of cylinders only if the engine has reached a predetermined minimum operating temperature.

17. A system according to claim 8, wherein the processor will select an operating condition with less than the maximum number of cylinders only if the vehicle has reached a predetermined minimum operating speed.

18. A system for selecting the number of cylinders to be operated in a multicylinder variable displacement internal combustion engine installed in a vehicle having a driver operable accelerator control, comprising:

an accelerator control position sensor for determining the operating position of the accelerator control and for generating an accelerator control position signal indicating such position as a function of time;

an engine speed sensor for determining the speed of the engine and for generating an engine speed signal indicating such speed; and a processor containing predetermined limit values for engine speed and a transfer function of accelerator control position, with said processor further comprising means for receiving said accelerator control position and engine speed signals, means for calculating the value of said accelerator control position function, and means for selecting fractional operation in the event that sensed engine speed and the value of said accelerator control position function lie between said predetermined limit values, with said processor generating a value for the accelerator control limit values based upon the length of time between changes in the number of operating cylinders.

* * * * *